US005433375A

United States Patent [19]

Warrick

[11] Patent Number: 5,433,375

[45] Date of Patent: Jul. 18, 1995

[54] NEWSPAPER RECEPTACLE

[76] Inventor: F. Gordon Warrick, 829 S. Lexington Pkwy., St. Paul, Minn. 55116

[21] Appl. No.: 200,005

[22] Filed: Feb. 22, 1994

[51] Int. Cl.[6] ..... B65D 91/00

[52] U.S. Cl. ..... 232/1 C; 232/22

[58] Field of Search ..... 232/1 C, 17, 22, 33, 232/42

[56] References Cited

U.S. PATENT DOCUMENTS

| | | | |
|---|---|---|---|
| 948,556 | 2/1910 | Turner | 232/22 |
| 2,470,138 | 5/1949 | Browning | 232/22 |
| 3,086,674 | 4/1963 | Scheuerman | 232/1 C |
| 4,066,208 | 1/1978 | Jones | 232/1 C |
| 4,494,690 | 1/1985 | Dupuis | 232/1 C X |
| 4,703,850 | 11/1987 | Walker | 232/22 X |
| 4,746,062 | 5/1988 | Bartylla | 232/1 C |
| 4,901,912 | 2/1990 | Pinard | 232/1 C |
| 5,150,834 | 9/1992 | Bourke | 232/1 C |

*Primary Examiner*—Jerry Redman

[57] ABSTRACT

The receptacle is for receiving and retaining newspapers and the like and is removably attached to a door. A front panel of the receptacle has and opening in its upper section to receive delivered newspapers. The rear panel has an opening for retrieving the newspaper, but the opening abuts the door and cannot be accessed until the receptacle is removed from the door. A series of dentals on the rear panel extend into the receptacle to deter unauthorized removal of the paper. A flange is provided on the upper end of the receptacle to mount it no the upper edge of a door.

5 Claims, 3 Drawing Sheets

NEWSPAPER RECEPTACLE

FIELD OF THE INVENTION

This invention relates to a receptacle for the delivery of various articles such as newspapers and the like. More specifically, it relates to a receptacle to be placed on the outside door of a residence or office to prevent the theft of newspapers and other delivered materials.

BACKGROUND OF INVENTION

Delivery of items such as newspapers, magazines and even small houseware and office items to multiple occupancy dwellings and offices can be a problem. If they are placed on the floor in front of the appropriate door they can be readily stolen.

Such receptacles should make removal of the delivered item difficult by unauthorized persons. It should be readily and simply attached to and detached from the door without damaging the door, a requirement of many landlords. It should provide easy access to the intended recipient of the newspaper or other item. It should use a minimum of material in its construction, be lightweight, and be inexpensive to manufacture.

Heretofore, devices for this purpose have been fastened to the door or jamb. One end of the device allows passage of the newspaper inside but restricts removal in some way. The other end allows removal only after unlocking the receptacle or, when the door is open.

U.S. Pat. No. 4,066,208, for example, would be complex and expensive to manufacture, and would require assembly before use. It cannot be used in the same configuration on both left and right hand opening doors. Its effective use requires that the paper be tightly rolled. That would be almost impossible with the Sunday newspaper of many large cities.

U.S. Pat. No 4,494,690 can only be used with a door of a given thickness, which matches the attachment clip. The retaining clip would slide down the door unless fastened with nails, screws, etc. It would be expensive to manufacture, and require some assembly by the user based on the choice of the opposing door jamb.

U.S. Pat. No. 4,746,062 must be affixed permanently to the door with screws or nails, and would be quite complex and expensive to manufacture.

U.S. Pat. No. 4,901,912 also must be affixed permanently to the door via the door handle, and cannot be used in the same configuration on both left and right hand opening doors.

U.S. Pat. No. 5,150,834 would be complex and expensive to manufacture, and it would restrict access to the door knob.

SUMMARY OF THE INVENTION

Accordingly, several objects and advantages of my invention are: 1) it can be manufactured from plastic, or some other lightweight, strong, inexpensive material, in a one step process, 2) it can be easily hung on the front door, with no assembly required, 3) it does not need to be attached by screws or nails to the door and does not damage the door, 4) it requires no keys, locks, or complex parts to discourage theft, 5) it is not necessary for it to abut the door jamb to restrict unwanted removal, 6) it may be used on either right or left hand opening doors, 7) it is large enough to contain the largest Sunday newspaper without projecting dangerously beyond the door jamb, 8) and, because of its relatively simple manufacture, it can be sold at a price commensurate with the protection of an item as inexpensive as a newspaper.

Further objects and advantages of my invention will become apparent from a consideration of the drawings and ensuing description of it.

DETAILED DESCRIPTION OF THE PREFERRED EMBODIMENT

Figure 2:
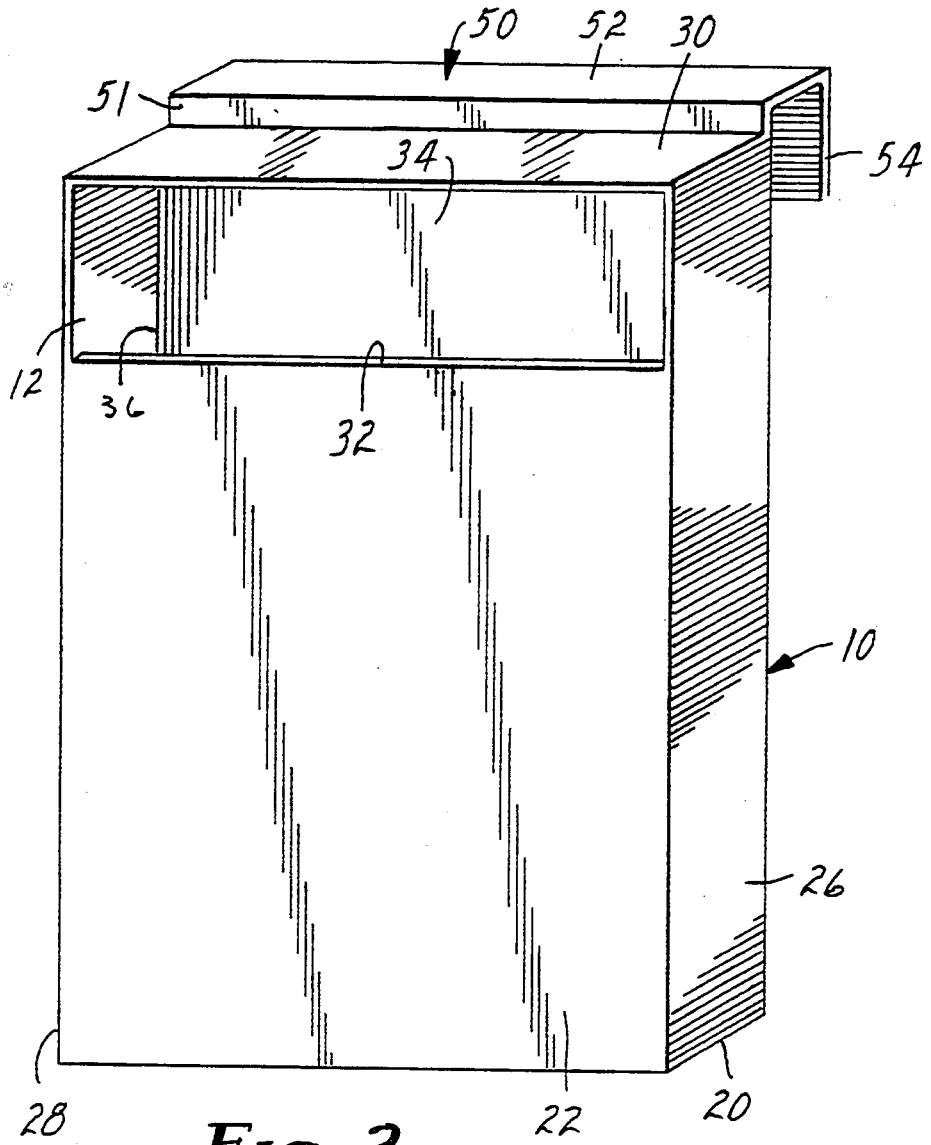
FIG. 2 is a front perspective view of the invention.
Figure 3:
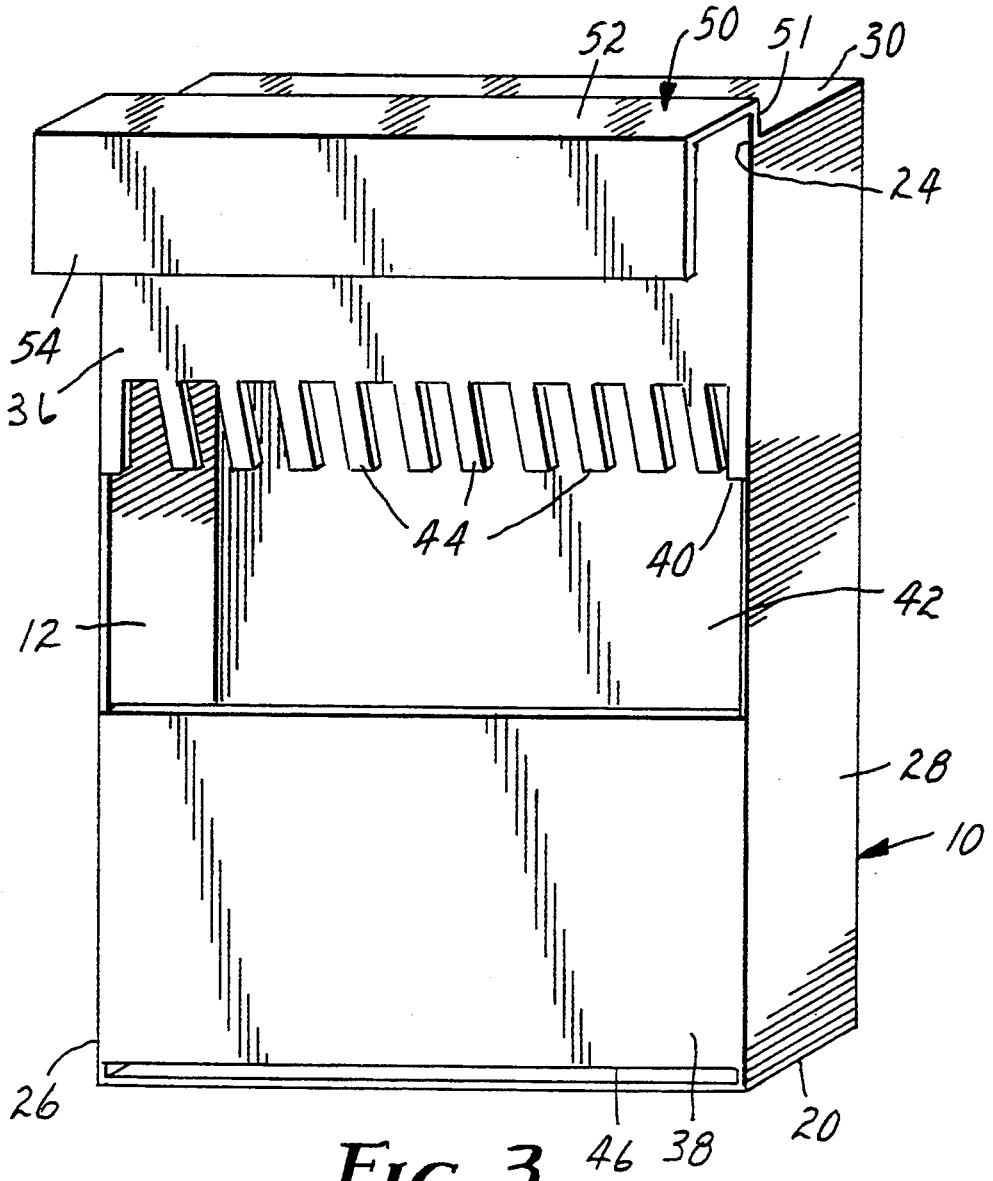
FIG. 3 is a rear perspective view of the invention showing the dentals along the lower edge of the upper rear panel.

FIGS. 2 and 3 are perspective views of the panels that make up the preferred embodiment of the receptacle generally designated 10. The receptacle comprises a series of integrally joined panels forming a hollow chamber 12 for receiving newspapers and the like. The panels best visualized in FIGS. 2 and 3, consist of a rectangular bottom panel 20 having the lower edge of the front panel 22 integrally joined to one of the bottom panel's long edges. A pair of opposing side panels 26 and 28 integrally joined to the opposing short edges of panel 20 extend upwards therefrom to the upper end of the receptacle where they join top panel 30. Panel 30 is in essence a matching rectangular panel to bottom panel 20 and the side panels 26 and 28 are integrally joined thereto in the same manner as their juncture with panel 20. Front panel 22 extends up from panel 20 with its side edges integrally joined to on edge of side panels 26 and 28 as best visualized by viewing FIG. 2. However, its upper edge 32 does not join top panel 30, but rather its upward extension is truncated so that the upper edge 32 of panel 22 is spaced from top panel 30 to form the opening 34 into which the delivered newspaper or the like is placed into the receptacle.

Turning now to FIG. 3 the rear panel of the receptacle is divided into two sections, namely an upper rear panel 36 and a lower panel 38. The upper edge 24 of upper panel 36 is integrally formed with the long edge of top panel 30 and the top portions of side panels 26 and 28. Panel 36 extends downward toward lower rear panel 38, but panel 36's lower edge 40 is spaced from lower rear panel 38 to form an opening 42 in the rear panel for retrieving the items delivered to the receptacle as hereinafter explained. Lower edge 40 throughout its length consists of a series of dentals 44 which are angled toward the inner surface of front panel 22 to permit articles such as newspapers and the like to freely fall into the lower part of the receptacle, but form a serrated edge deterring one from attempting to remove the newspaper, etc. by placing a hand into front panel opening 34.

The lower rear panel 38 completes the chamber portion of the receptacle. Its side edges are integrally joined to side panels 26 and 28, but its lower edge 46 terminates in spaced relating with bottom panel 20. This space facilitates movement of air at the bottom of the panel for drying and drainage of moisture that results from delivery of damp newspapers and the like.

Figure 5:
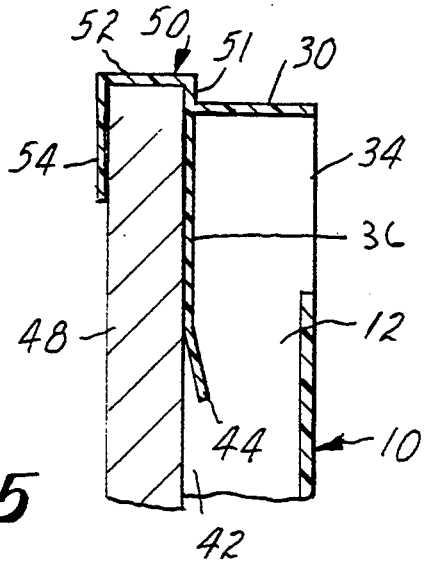
FIG. 5 is a sectional view along lines 5—5 of FIG. 4.
Figure 4:
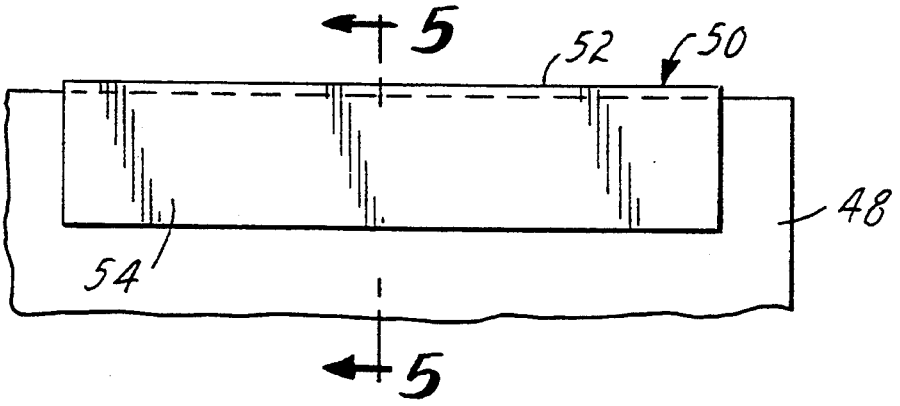
FIG. 4 is a rear view of the retainer flange attached to a door.

FIGS. 4 and 5 illustrate the flange for attaching and removing the receptacle to and from door 48. Flange generally described 50 is integrally formed with the juncture of upper rear panel 36 and top panel 30 and has plate 52 extending rearward of the receptacle slightly above the plane of top 30 a distance substantially equal to the thickness of the front entry doors of apartments, dwellings, offices, etc. Protruding above rear panel 36 is extension 51 integral with panel 36 and connected to plate 52. An anchoring plate 54 is joined to the outer edge of plate 52 and extends 90 degrees therefrom toward the lower end of the receptacle and down the inner surface of door 48 a distance sufficient to firmly fasten the receptacle to the door.

The panels and flange 50 are preferably made of plastic material and manufactured as an integrally molded unit. The panels may also be made of sheet metal and suitably welded together. However, because of ease and economy of manufacture, plastic is preferred. As a result, cost of production is reduced and because of ease of manufacture and resulting light weight, marketing and distribution can be economically carried out. These features result in a highly efficient receptacle that can be retailed at low cost.

In operation, the unit is suspended on the upper edge of a door 48 by opening the door and sliding or placing flange 50 over the door's upper edge. When the door is closed the device is secured in place by the jambs in the upper part of the door plate 52 wedged between the upper edge of the door and the upper jamb. Delivery of newspapers and the like are made by placing the paper through opening 34. The paper cannot be surreptitiously retrieved from opening 24 as dentals 42 restrict movement of the hand into the lower part of the receptacle. Moreover, opening 42 is secured in closure mode as it is disposed against the outer surface of door 48. The receptacle, however, is not disposed against the outer surface of the door in such firm position that air or moisture is prevented from passing through opening 46 adjacent the juncture of bottom panel 20 and lower rear panel 38.

Figure 1:
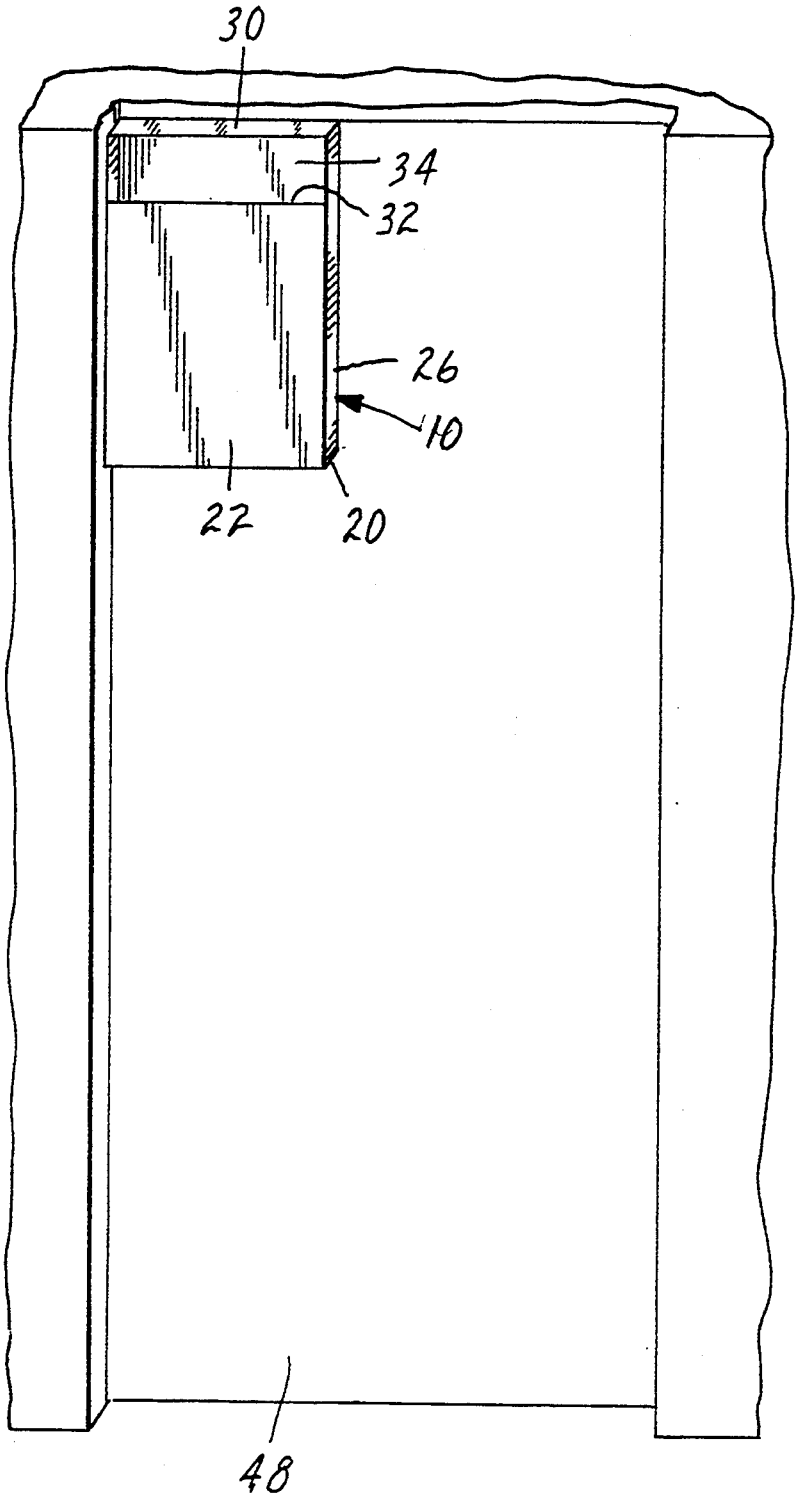
FIG. 1 is a perspective view of the invention attached to a door.

In order to remove delivered items such as newspapers, door 48 is opened and receptacle 10 is removed therefrom by lifting it off or by sliding it along the upper edge of the door as visualized form FIG. 1 and 5. The delivered item is then retrieved from the receptacle by reaching into it through opening 42.

A preferred embodiment of the present invention has been described. However, it should be understood that various changes, adaptations, and modifications may be made without departing from the concept of the invention and the scope of the appended claims.

What is claimed:

1. A receptacle removeably mounted on a door for receiving newspapers comprising:

a) A chamber formed by integrally joined bottom, top, front, side, and rear panels each substantially planar, an upper edge of the front panel spaced from the top panel to form an opening for receiving a newspaper, the rear panel having an upper section extending downward from its juncture with the top panel and terminating in a lower edge extending transversely across a rear side of the receptacle, the edge having a continuous series of discrete dentals thereon and said rear panel further having a lower section with its upper edge spaced from the dentals defining an open area for removing the newspaper when the receptacle is removed from the door and an enclosed area in cooperation with the door when the receptacle is mounted on the door, said lower section further having a lower edge terminating in spaced relation with the bottom panel; and b) Means integral with the juncture of the rear and top panels for maintaining the receptacle on the door.

2. The receptacle of claim 1 wherein the discrete dentals on the lower edge of the upper section are individual tabs bent toward the front panel to provide means for restraining attempts to remove the newspaper through the opening formed between the upper edge of the front panel and the top panel.

3. The receptacle of claim 1 wherein the means for mounting the receptacle on the door comprise flanges extending from the juncture of the top and rear panels across an upper edge of the door and bending ninety degrees therefrom to extend down the surface of a door opposite a surface onto which the receptacle is mounted.

4. A receptacle into which delivered articles may be contained and adaptable to be removably affixed to a door comprising:

a) A bottom and top panel for enclosing opposing ends of the receptacle;

b) A pair of opposed side panels integrally joined to the bottom panel and extending upward therefrom and integrally joined with the top panel;

c) A front panel integrally joined with the side and bottom panels and extending up from the bottom panel, an upper edge of the front panel terminating in a spaced relationship with the top panel sufficient to form and opening therewith into which a newspaper can be inserted into the receptacle;

d) An upper rear panel integrally joined along its upper and side edges to edges of the top and side panels, said upper panel having a lower edge containing a series of rigid dentals therealong angularly oriented into an interior of the receptacle and toward an inner face of the front panel to deter retrieval of articles dispensed into the receptacle through the space between the top panel and upper edge of the front panel;

e) A second rear panel extending up from the bottom panel of the receptacle, its upper edge spaced from the dentals of the upper rear panel to form an opening therewith for retrieval of articles when the receptacle is removed from the door and which access thereto is prevented when the receptacle is affixed to the door when in a closed position, said rear panel further having its lower edge disposed in spaced relation to said bottom panel; and f) A flange consisting of retaining plates joined to the receptacle along the juncture where the top panel is joined to the upper edge of the upper rear panel, said plates adapted to wrap around a top edge and onto the inner surface of said door.

5. The receptacle of claim 4 wherein the lower edge of said second rear panel disposed in spaced relation with said bottom panel forms an opening at the bottom of the receptacle to provide drainage of moisture that may accumulate in said receptacle.

* * * * *